US007002329B2

(12) United States Patent
Agari et al.

(10) Patent No.: US 7,002,329 B2
(45) Date of Patent: Feb. 21, 2006

(54) VOLTAGE REGULATOR USING TWO OPERATIONAL AMPLIFIERS IN CURRENT CONSUMPTION

(75) Inventors: Hideki Agari, Osaka (JP); Kohji Yoshii, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/469,642

(22) PCT Filed: Apr. 8, 2002

(86) PCT No.: PCT/JP02/03497

§ 371 (c)(1),
(2), (4) Date: Sep. 3, 2003

(87) PCT Pub. No.: WO02/084426

PCT Pub. Date: Oct. 24, 2002

(65) Prior Publication Data

US 2004/0130305 A1 Jul. 8, 2004

(30) Foreign Application Priority Data

Apr. 10, 2001 (JP) ..... 2001-111269

(51) Int. Cl.
*G05F 1/573* (2006.01)
*G05F 1/40* (2006.01)

(52) U.S. Cl. ..... 323/284; 323/282; 323/274

(58) Field of Classification Search ..... 323/284, 323/282, 285, 274, 275
See application file for complete search history.

(56) References Cited

U.S. PATENT DOCUMENTS 6,150,798 A 11/2000 Ferry et al.
6,150,804 A 11/2000 Taghizadeh-Kaschani
6,534,960 B1 * 3/2003 Wells et al. ..... 323/222
6,577,109 B2 * 6/2003 Dancy et al. ..... 323/272
6,580,258 B2 * 6/2003 Wilcox et al. ..... 323/282
6,674,274 B2 * 1/2004 Hobrecht et al. ..... 323/285

FOREIGN PATENT DOCUMENTS

| | | |
|---|---|---|
| JP | 02-039607 | 2/1990 |
| JP | 06-295211 | 10/1994 |
| JP | 06-325568 | 11/1994 |
| JP | 07-037381 | 2/1995 |
| JP | 07-193447 | 7/1995 |
| JP | 10-111723 | 4/1998 |
| JP | 2001-222331 | 8/2001 |

* cited by examiner

*Primary Examiner*—Bao Q. Vu
(74) *Attorney, Agent, or Firm*—Dickerstein Shapiro Morin & Oshinsky LLP

(57) ABSTRACT

A voltage regulator, which generates and outputs a given voltage based on a preset reference voltage, includes: a detection circuit part detecting the output voltage and generating and outputting a voltage based on the detected voltage; first and second operational amplifiers each comparing the output voltage of said detection circuit part and the preset reference voltage and outputting a voltage representing a comparison result, the first operational amplifier being controlled based on control signals supplied externally and consuming a larger amount of electric current than the second operational amplifier; and an output circuit part comprising an output transistor outputting an electric current based on the output voltages of the first and second operational amplifiers.

10 Claims, 7 Drawing Sheets

VOLTAGE REGULATOR USING TWO OPERATIONAL AMPLIFIERS IN CURRENT CONSUMPTION

TECHNICAL FIELD

The present invention relates to voltage regulators, and more particularly to a voltage regulator having the function of switching between a high-speed operation mode and a low-electric-current consumption operation mode.

BACKGROUND ART

Conventional voltage regulators are divided into two types: those having a circuit configuration consuming a large amount of electric current to increase power-supply rejection ratio (PSRR) and load transient response and those requiring no high-speed response and thus having a circuit configuration consuming a smaller amount of electric current. If a voltage regulator having high-speed response is employed in an apparatus, such as a cellular phone, that consumes a normal amount of electric current in an operating state and a reduced amount of electric current in a wait state such as in a sleep mode, the voltage regulator incurs a great loss in electric current consumption when the apparatus is in the wait state where no high-speed response is needed.

Accordingly, as shown in FIG. 1, a voltage regulator 101 that consumes a large amount of electric current but has high-speed response and a low-speed-operation voltage regulator 102 whose electric current consumption is controlled to a lower level are provided to be connected to a load 110 via a changeover switch 103. The voltage regulators 101 and 102 have respective output transistors 105 and 106 of different sizes, but are equal in configuration. The output transistor 105 of the voltage regulator 101 has a large electric current supply capacity.

The changeover switch 103 exclusively connects the voltage regulator 101 or 102 to the load 110 based on a control signal supplied from an external control apparatus 111. That is, when the load 110 operates with a normal amount of electric current consumption, the control apparatus 111 controls the changeover switch 103 so that the load 110 is connected to the output terminal of the voltage regulator 101.

On the other hand, when the load 110 operates with a reduced amount of electric current consumption, the control apparatus 111 controls the changeover switch 103 so that the load 110 is connected to the output terminal of the voltage regulator 102. Thus, by selectively using the voltage regulator 101 or 102 based on an amount of electric current consumed by the load 110, the amount of electric current consumed by the voltage regulators 101 and 102 can be controlled or reduced.

According to such a configuration, however, the output transistors 105 and 106 each require a large area on the chip if the voltage regulators 101 and 102 and the changeover switch 103 are formed on the same single semiconductor chip. Further, the same amount of electric current that flows through the output transistors 105 and 106 is required to flow through the changeover switch 103, so that a large chip area is required to reduce the resistance of the changeover switch 103. Accordingly, in the case of forming the voltage regulators 101 and 102 and the changeover switch 103 on a single semiconductor chip, the chip area increases to incur an increase in cost.

DISCLOSURE OF THE INVENTION

Accordingly, it is a general object of the present invention to provide a voltage regulator in which the above-described disadvantage is eliminated.

A more specific object of the present invention is to provide a voltage regulator that can speed up response and control electric current consumption based on the condition of a load without increasing chip area.

The above objects of the present invention are achieved by a voltage regulator generating and outputting a given voltage based on a preset reference voltage, the voltage regulator including: a detection circuit part detecting the output voltage and generating and outputting a voltage based on the detected voltage; first and second operational amplifiers each comparing the output voltage of said detection circuit part and the preset reference voltage and outputting a voltage representing a comparison result, the first operational amplifier being controlled based on control signals supplied externally and consuming a larger amount of electric current than the second operational amplifier; and an output circuit part comprising an output transistor outputting an electric current based on the output voltages of said first and second operational amplifiers.

Additionally, in the above-described voltage regulator, the first operational amplifier may stop consuming electric current and stop operating when a given control signal is input thereto.

According to the voltage regulator of the present invention, the first operational amplifier operates in a normal operation mode so that the voltage regulator has good high-speed response, and the first operational amplifier stops operating and only the second operational amplifier operates in a low-electric-current consumption operation mode so that the voltage regulator operates with low electric current consumption. Thereby, the response of the voltage regulator is speeded up or electric current consumption by the voltage regulator is controlled or reduced based on the condition of a load. Further, since the driver transistor of the output circuit part can be shared by the first and second operational amplifier, that is, can be used in both the normal operation mode and the low-electric-current consumption operation mode, the chip area of the voltage regulator can be reduced so that the production cost thereof can be decreased.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description will now be given, with reference to the accompanying drawings, of embodiments of the present invention.

[First Embodiment]

Figure 1:
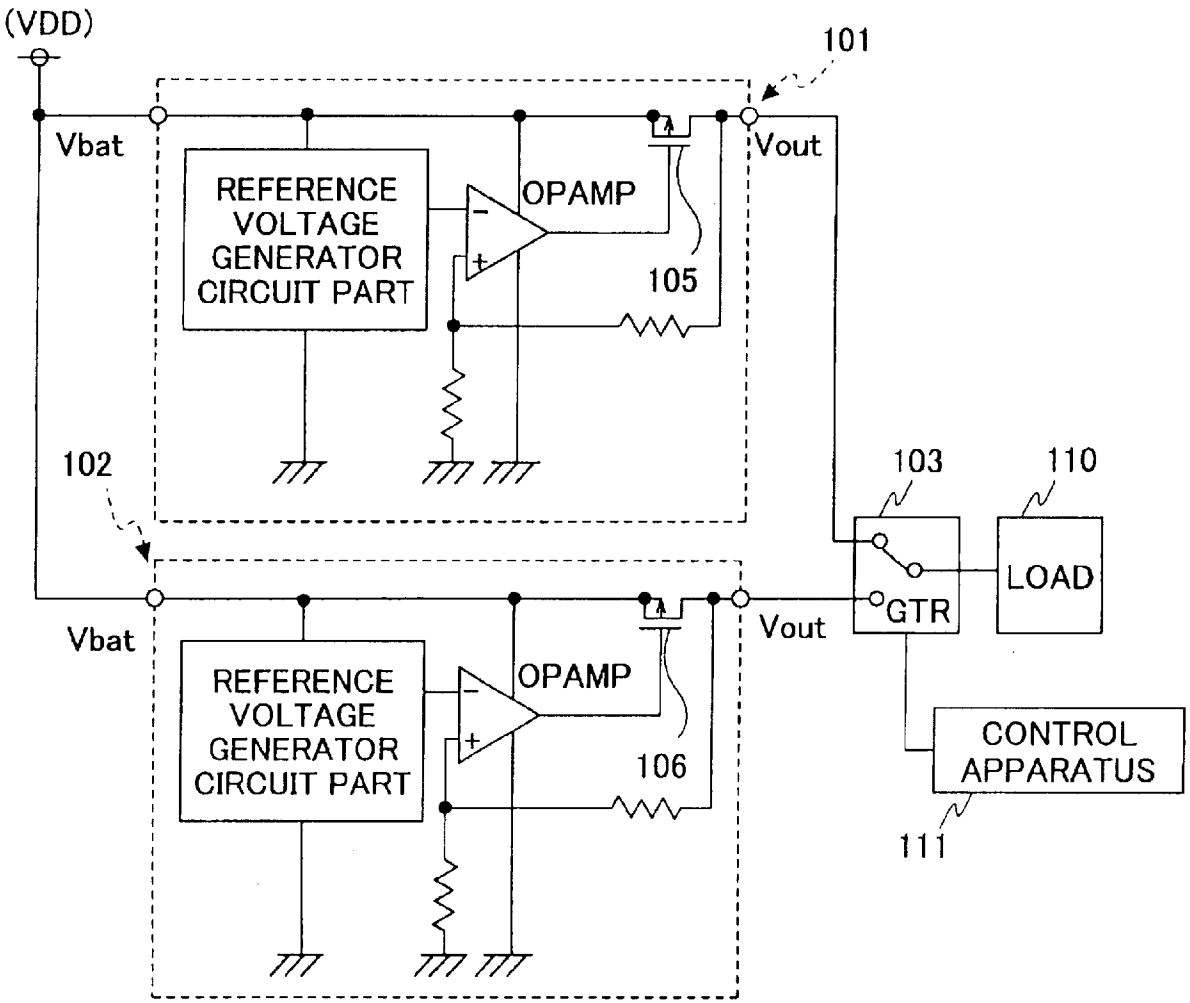
FIG. 1 is a diagram showing a circuit configuration of a conventional voltage regulator.
Figure 2:
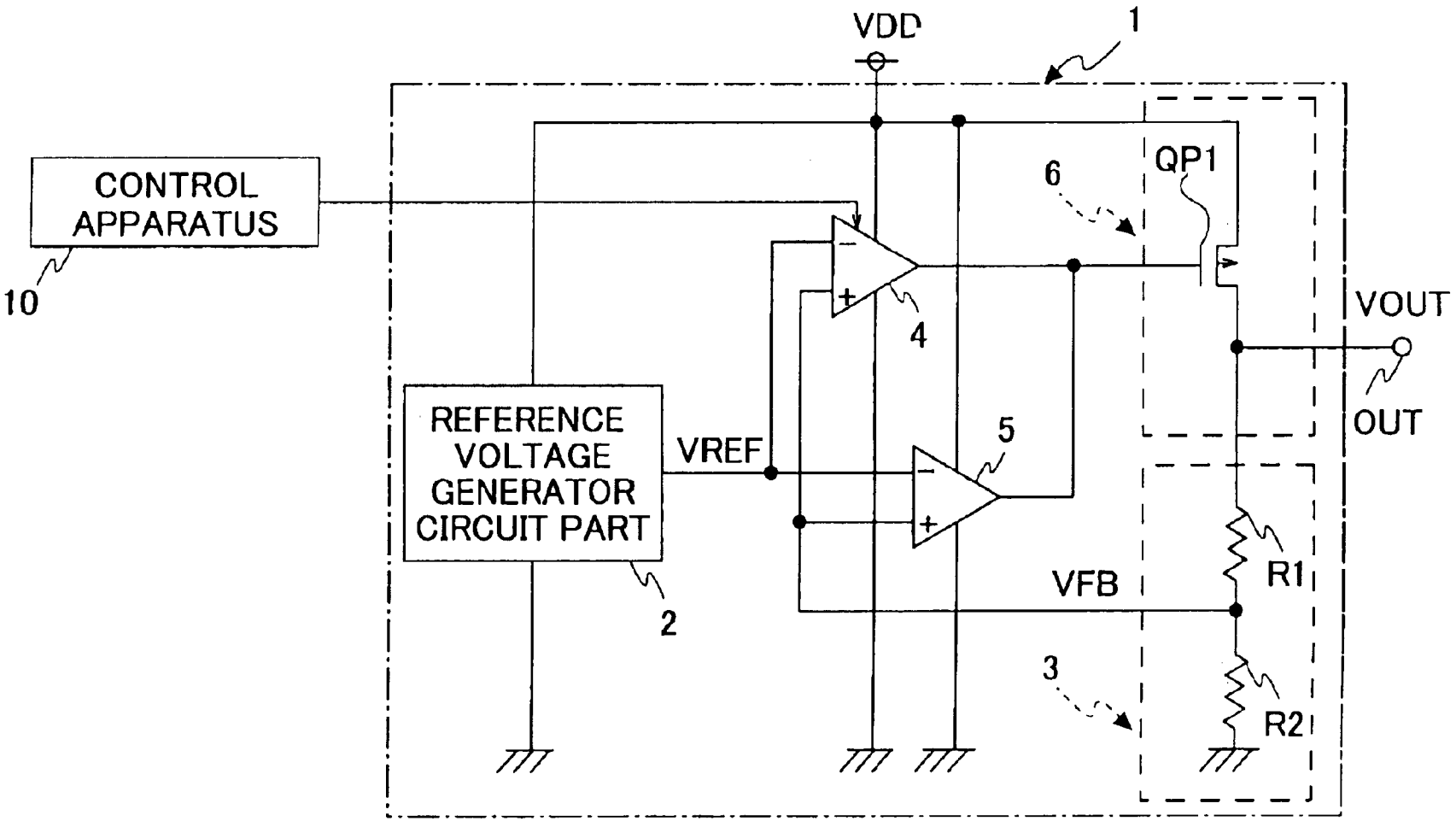
FIG. 2 is a schematic diagram showing a voltage regulator according to a first embodiment of the present invention.

FIG. 2 is a schematic diagram showing a voltage regulator 1 according to a first embodiment of the present invention.

In FIG. 2, the voltage regulator 1 includes a reference voltage generator circuit part 2, a detection circuit part 3, a first operational amplifier 4, and a second operational amplifier 5. The reference voltage generator circuit part 2 generates and outputs a given reference voltage VREF. The detection circuit part 3 detects an output voltage VOUT, and generates and outputs a voltage VFB based on the detected output voltage VOUT. The first operational amplifier 4, which consumes a large amount of electric current but can operate at a high speed, compares the reference voltage VREF and the voltage VFB supplied from the detection circuit part 3 and outputs the comparison result. The second operational amplifier 5, whose electric current consumption is controlled (to a smaller amount than the first operational amplifier 4), compares the reference voltage VREF and the voltage VFB and outputs the comparison result.

Further, the voltage regulator 1 includes an output circuit part 6 that outputs an electric current based on the output signals of the first and the second operational amplifiers 4 and 5 to make constant the output voltage VOUT output from an output terminal OUT. The detection circuit part 3 is formed of a series circuit of resistors R1 and R2 connected between the output voltage VOUT and ground. The output circuit part 6 is formed of a p-channel MOS transistor (hereinafter referred to as a PMOS transistor) QP1 that forms a driver transistor outputting the electric current based on the output voltages of the first and the second operational amplifiers 4 and 5.

The reference voltage VREF output from the reference voltage generator circuit part 2 is applied to the inverting input terminal of each of the first and second operational amplifiers 4 and 5. The voltage VFB, which is obtained by dividing the output voltage VOUT proportionally between the resistors R1 and R2, is applied to the non-inverting input terminal of each of the first and second operational amplifiers 4 and 5. The output voltage of each of the first and second operational amplifiers 4 and 5 is applied to the gate of the PMOS transistor QP1 connected between a supply voltage VDD and the output terminal OUT. The operation of the first operational amplifier 4 is controlled based on control signals input from an external control apparatus 10. That is, the control apparatus 10 causes the first operational amplifier 4 to operate in the case of performing a normal operation (a normal operation mode), and stops the operation of the first operational amplifier 4 by stopping the first operational amplifier 4 from consuming electric current in the case of performing an operation with a reduced amount of electric current (a low-electric-current consumption operation mode).

Figure 3:
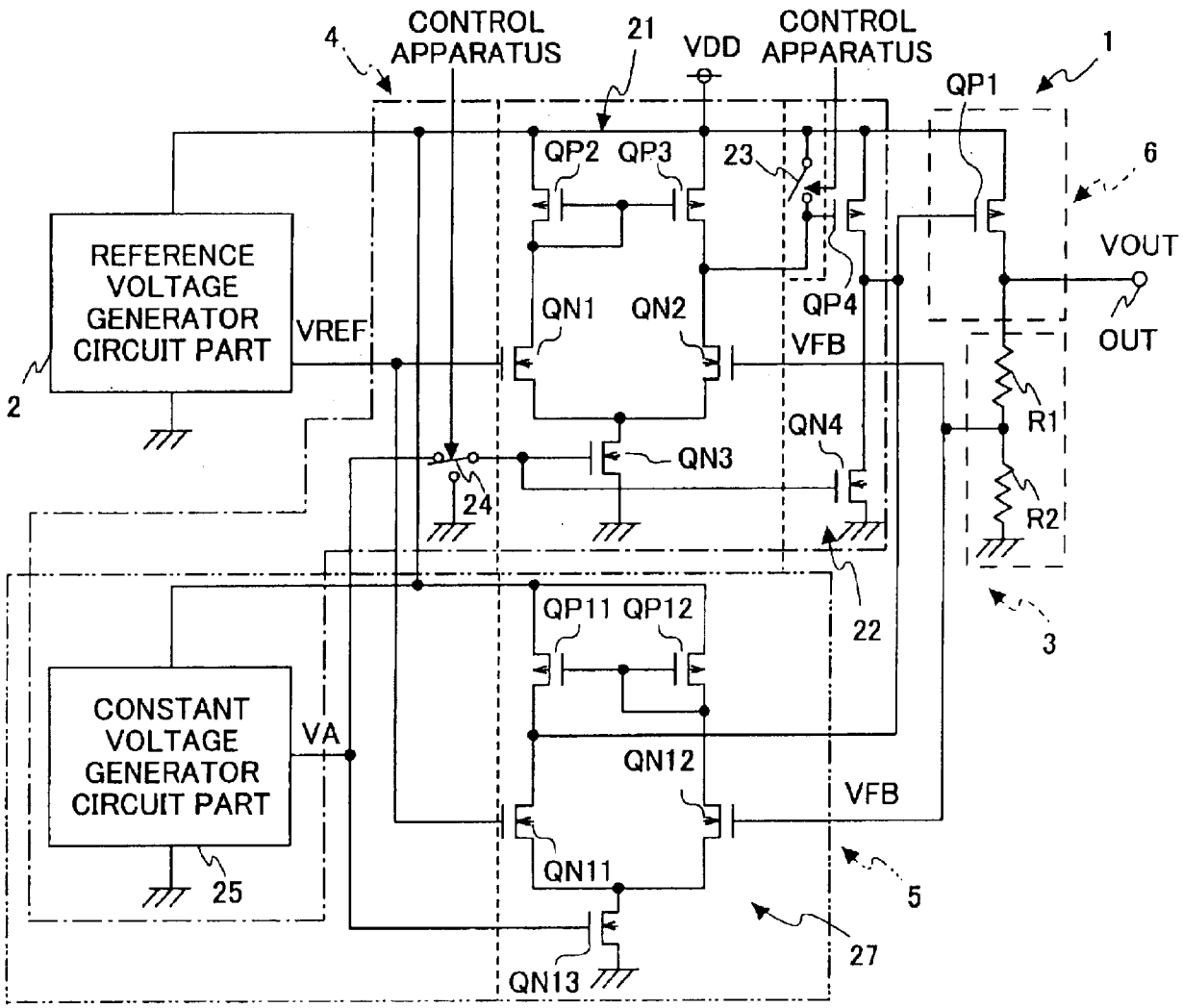
FIG. 3 is a diagram showing a circuit configuration of the voltage regulator of FIG. 2.

FIG. 3 is a diagram showing a circuit configuration of the voltage regulator 1 of FIG. 2. In FIG. 3, the first operational amplifier 4 includes a differential amplifier circuit part 21 and an amplifier circuit part 22. The differential amplifier circuit part 21 compares the reference voltage VREF and the voltage VFB supplied from the detection circuit part 3 and outputs the comparison result. The amplifier circuit part 22 amplifies a voltage that represents the comparison result output from the differential amplifier circuit part 21 and outputs the amplified voltage. The first operational amplifier 4 further includes a first switch 23, a second switch 24, and a constant voltage generator circuit part 25. The first switch 23 stops the operation of the amplifier circuit part 22 based on the control signal supplied from the control apparatus 10. The second switch 24 cuts off the supply of electric current to the differential amplifier circuit part 21 and the amplifier circuit part 22 based on the control signal supplied from the control apparatus 10. The constant voltage generator circuit part 25 generates and outputs a given constant voltage VA. The first switch 23 forms an output control part.

The differential amplifier circuit part 21 is formed of PMOS transistors QP2 and QP3 forming a current mirror circuit, n-channel MOS transistors (hereinafter referred to as NMOS transistors) QN1 and QN2 forming a differential pair, and an NMOS transistor QN3 forming a constant current source. The amplifier circuit part 22 is formed of a PMOS transistor QP4 and an NMOS transistor QN4 forming a constant current source. The constant voltage VA is applied from the constant voltage generator circuit part 25 to the gate of each of the NMOS transistors QN3 and QN4.

In the differential amplifier circuit part 21, the gate and the drain of the PMOS transistor QP2 and the gate of the PMOS transistor QP3 are connected. The source of each of the PMOS transistors QP2 and QP3 is connected to the supply voltage VDD. The drain of the PMOS transistor QP2 is connected to the drain of the NMOS transistor QN1. The drain of the PMOS transistor QP3 is connected to the drain of the NMOS transistor QN2.

The reference voltage VREF supplied from the reference voltage generator circuit part 2 is input to the gate of the NMOS transistor QN1. The voltage VFB obtained by dividing the output voltage VOUT proportionally between the resistors R1 and R2 is input to the gate of the NMOS transistor QN2. Further, the sources of the NMOS transistors QN1 and QN2 are connected. The NMOS transistor QN3 is connected between the connection between the sources of the NMOS transistors QN1 and QN2 and ground. The constant voltage VA supplied from the constant voltage generator circuit part 25 is applied via the second switch 24 to the gate of the NMOS transistor QN3 so that the NMOS transistor QN3 operates as a constant current source together with the constant voltage generator circuit part 25. The NMOS transistor QN3 and the constant voltage generator circuit part 25 form a first constant current source.

Next, in the amplifier circuit part 22, the PMOS transistor QP4 and the NMOS transistor QN4 are connected in series between the supply voltage VDD and ground. The gate of the PMOS transistor QP4 is connected to the connection between the PMOS transistor QP3 and the NMOS transistor QN2 in the differential amplifier circuit part 21. Further, the first switch 23 is connected between the gate of the PMOS transistor QP4 and the supply voltage VDD. The constant voltage VA supplied from the constant voltage generator circuit part 25 is applied via the second switch 24 to the gate of the NMOS transistor QN4 so that the NMOS transistor QN4 operates as a constant current source together with the constant voltage generator circuit part 25. The NMOS transistor QN4 and the constant voltage generator circuit part 25 form a second constant current source, and the second switch 24 forms a constant current source control part.

On the other hand, the gate of the PMOS transistor QP1 of the output circuit part 6 is connected to the connection between the PMOS transistor QP4 and the NMOS transistor QN4 of the amplifier circuit part 22. The source of the PMOS transistor QP1 is connected to the supply voltage VDD. The series circuit of the resistors R1 and R2 of the detection circuit part 3 is connected between the drain of the PMOS transistor QP1 and ground. The drain of the PMOS transistor QP1 is connected to the output terminal OUT of the voltage regulator 1. A load (not shown in the drawing) is connected between the output terminal OUT and ground.

Next, the second operational amplifier 5 includes the constant voltage generator circuit part 25 and a differential amplifier circuit part 27 that compares the reference voltage VREF and the voltage VFB supplied from the detection circuit part 3 and outputs the comparison result. Thus, the constant voltage generator circuit part 25 is shared by the first and second operational amplifiers 4 and 5. The differential amplifier circuit part 27 is formed of PMOS transistors QP11 and QP12 forming a current mirror circuit, NMOS transistors QN11 and QN12 forming a differential pair, and an NMOS transistor QN13 forming a constant current source.

In the differential amplifier circuit part 27, the gate of the PMOS transistor QP11 and the gate and the drain of the PMOS transistor QP12 are connected. The source of each of the PMOS transistors QP11 and QP12 is connected to the supply voltage VDD. The drain of the PMOS transistor QP11 is connected to the drain of the NMOS transistor QN11. The connection of the drain of the PMOS transistor QP11 to the drain of the NMOS transistor QN11 is connected to the gate of the PMOS transistor QP1 of the output circuit part 6. Further, the drain of the PMOS transistor QP12 is connected to the drain of the NMOS transistor QN12.

The reference voltage VREF supplied from the reference voltage generator circuit part 2 is input to the gate of the NMOS transistor QN11. The voltage VFB is input to the gate of the NMOS transistor QN12. Further, the sources of the NMOS transistors QN11 and QN12 are connected, and the NMOS transistor QN13 is connected between the connection between the sources of the NMOS transistors QN11 and QN12 and ground. The constant voltage VA supplied from the constant voltage generator circuit part 25 is applied to the gate of the NMOS transistor QN13 so that the NMOS transistor QN13 operates as a constant current source together with the constant voltage generator circuit part 25.

With the above-described configuration, the control apparatus 10, in the normal operation mode, switches OFF the first switch 23 to cut off the application of the supply voltage VDD to the gate of the PMOS transistor QP4 and switches the second switch 24 so that the constant voltage VA is applied to the gate of each of the NMOS transistors QN3 and QN4. Thus, in the normal operation mode, the voltage regulator 1 has three amplification steps (stages) performed respectively by the differential amplifier circuit part 21 and the amplification circuit part 22 of the first operational amplifier 4 and the output terminal part 6. Electric currents flowing through the NMOS transistors QN3 and QN4 that are the constant current sources amount to tens of microamperes ($\mu$A) so that the voltage regulator 1 has high-speed response.

Therefore, in the normal operation mode, if the output voltage VOUT is caused to lower in a state where the reference voltage VREF and the voltage VFB are balanced in the differential amplifier circuit part 21, the drain current of the NMOS transistor QN2 becomes smaller than the drain current of the NMOS transistor QN1. Therefore, the gate voltage of the PMOS transistor QP4 of the amplifier circuit part 22 rises so that the gate voltage of the PMOS transistor QP1 of the output circuit part 6 lowers. Thereby, the current driving capability of the PMOS transistor QP1 increases so as to be able to raise the output voltage VOUT.

Next, if the output voltage VOUT is caused to rise in the state where the reference voltage VREF and the voltage VFB are balanced in the differential amplifier circuit part 21, the drain current of the NMOS transistor QN2 becomes larger than the drain current of the NMOS transistor QN1. Therefore, the gate voltage of the PMOS transistor QP4 of the amplifier circuit part 22 lowers so that the gate voltage of the PMOS transistor QP1 of the output circuit part 6 rises. Thereby, the current driving capability of the PMOS transistor QP1 decreases to be able to lower the output voltage VOUT. Thus, the voltage regulator 1 is capable of maintaining the output voltage VOUT at a given constant voltage.

On the other hand, in the low-electric-current consumption operation mode, the control apparatus 10 switches ON the first switch 23 to apply the supply voltage VDD to the gate of the PMOS transistor QP4 and switches the second switch 24 so that the gate of each of the NMOS transistors QN3 and QN4 is grounded. Thus, in the low-electric-current consumption operation mode, the voltage regulator 1 has two amplification steps (stages) performed respectively by the differential amplifier circuit part 27 of the second operational amplifier 5 and the output circuit part 6. In this case, by adjusting the gate size of the NMOS transistor QN13, an electric current flowing through the NMOS transistor QN13 that is a constant current source can be controlled to a few microamperes, so that electric current consumption by the voltage regulator 1 can be reduced.

Therefore, in the low-electric-current consumption operation mode, if the output voltage VOUT is caused to lower in a state where the reference voltage VREF and the voltage VFB are balanced in the differential amplifier circuit part 27, the drain current of the NMOS transistor QN12 becomes smaller than the drain current of the NMOS transistor QN11, so that the gate voltage of the PMOS transistor QP1 of the output circuit part 6 lowers. Thereby, the current driving capability of the PMOS transistor QP1 increases to be able to raise the output voltage VOUT.

Next, if the output voltage VOUT is caused to rise in the state where the reference voltage VREF and the voltage VFB are balanced in the differential amplifier circuit part 27, the drain current of the NMOS transistor QN12 becomes larger than the drain current of the NMOS transistor QN11, so that the gate voltage of the PMOS transistor QP1 of the output circuit part 6 rises. Thereby, the current driving capability of the PMOS transistor QP1 decreases to be able to lower the output voltage VOUT. Thus, the voltage regulator 1 is capable of maintaining the output voltage VOUT at a given constant voltage.

Here, the differential amplifier circuit part 27 of the second operational amplifier 5 operates in both the normal operation mode and the low-electric-current consumption operation mode. However, in the normal operation mode, the first operational amplifier 4, which has a higher capability to drive the gate of the PMOS transistor QP1, also operates. Therefore, the operation of the second operational amplifier 5 hardly produces any effect. Further, if the second operational amplifier 5 is not in operation when the voltage regulator 1 switches from the normal operation mode to the low-electric-current consumption operation mode, the voltage regulator 1 has a poor response so as to output a ringing waveform. However, the output of the ringing waveform can be avoided by causing the second operational amplifier 5 to operate constantly.

Figure 4:
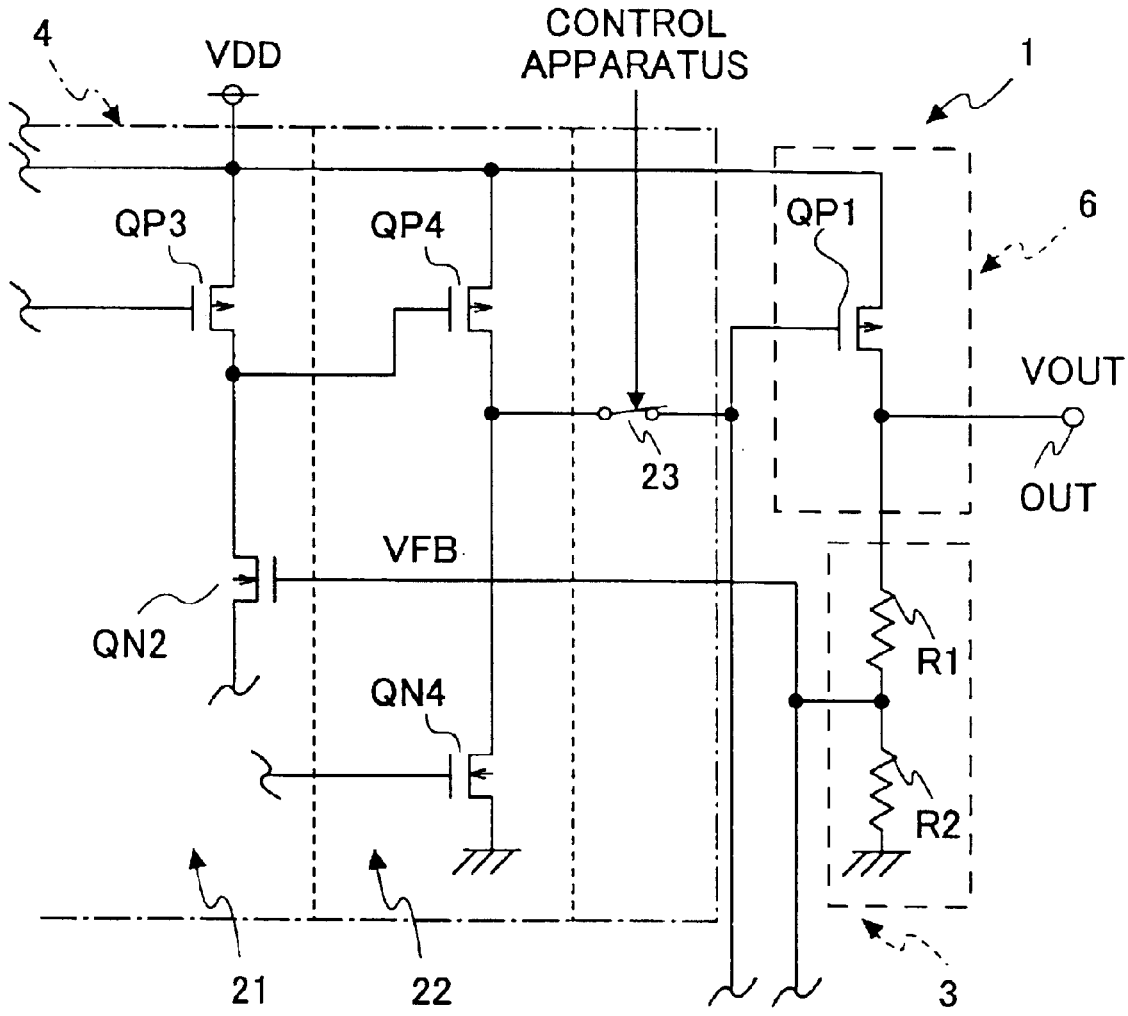
FIG. 4 is a diagram showing another circuit configuration of the voltage regulator of FIG. 2.

According to FIG. 3, the first switch 23 is provided between the supply voltage VDD and the gate of the PMOS transistor QP4. However, as shown in FIG. 4, which is a diagram showing another circuit configuration of the voltage regulator 1 of this embodiment, the first switch 23 may be provided between the connection between the PMOS transistor QP4 and the NMOS transistor QN4 and the gate of the PMOS transistor QP1 of the output circuit part 6. In this case, the control apparatus 10 switches ON the first switch 23 to establish electrical connection in the normal operation mode, and switches OFF the first switch 23 to cut off the connection in the low-electric-current consumption operation mode.

Figure 5:
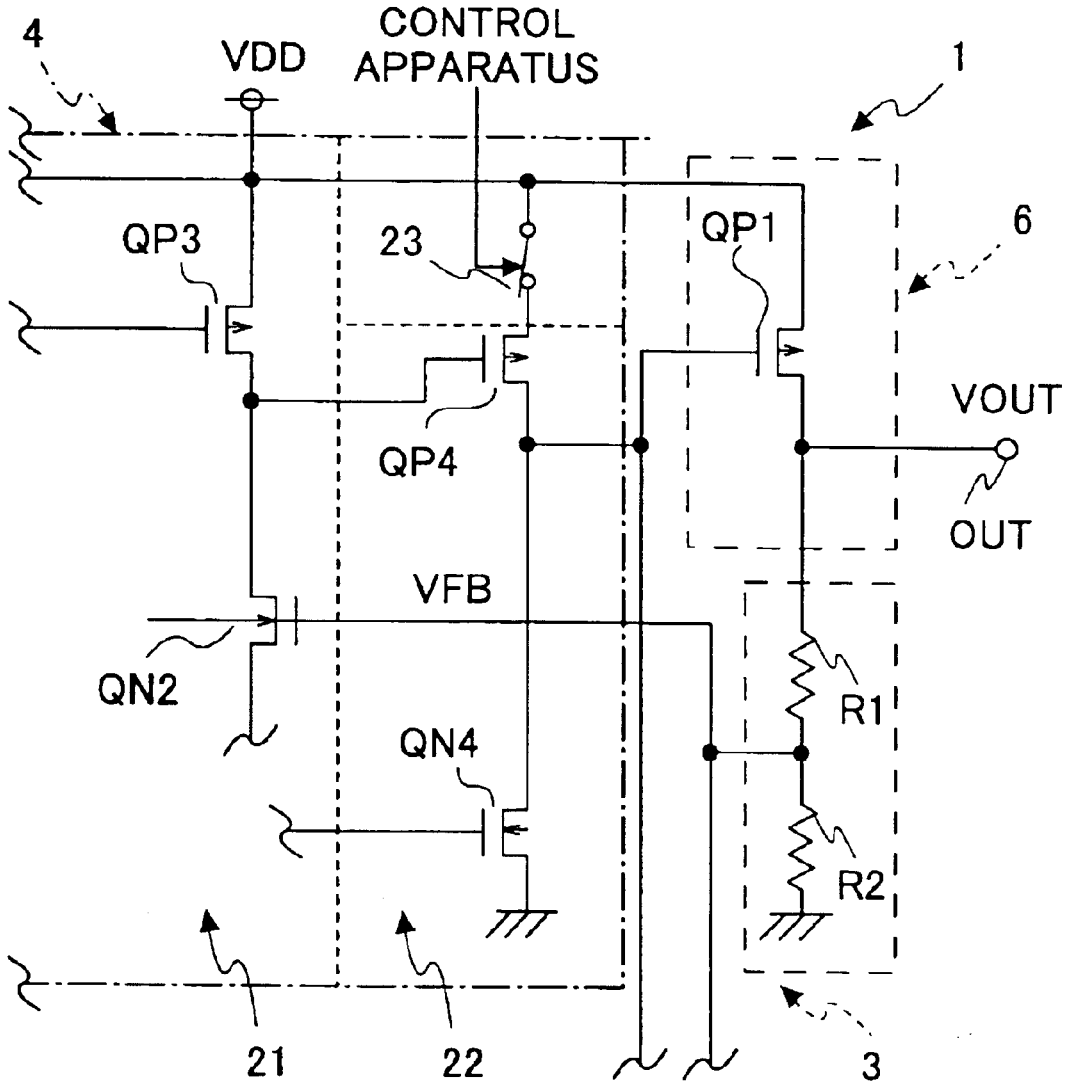
FIG. 5 is a diagram showing yet another circuit configuration of the voltage regulator of FIG. 2.

Further, the first switch 23 may be provided between the supply voltage VDD and the source of the PMOS transistor QP4 as shown in FIG. 5, which is a diagram showing yet another circuit configuration of the voltage regulator 1 of this embodiment. That is, the first switch 23 is only required to be provided at a position to intercept a signal output to the gate of the PMOS transistor QP1 in the amplifier circuit part 22. In this case, the control apparatus 10 also switches ON the first switch 23 to establish electrical connection in the normal operation mode, and switches OFF the first switch 23 to cut off the connection in the low-electric-current consumption operation mode. Each of FIGS. 4 and 5 shows the only part in which the voltage regulator 1 is different from FIG. 3, and omits the remaining part.

As described above, the voltage regulator 1 according to the first embodiment of the present invention puts the first operational amplifier 4 into operation in the normal operation mode to realize an excellent configuration in terms of high-speed response with the three amplification steps performed by the differential amplifier circuit part 21, the amplifier circuit part 22, and the output circuit part 6. In the low-electric-current consumption operation mode, the voltage regulator 1 stops the operation of the first operational amplifier 4 and causes only the second operational amplifier 5 to operate, thereby realizing a configuration operable with low-electric-current consumption with the two amplification steps performed by the differential amplifier circuit part 27 and the output circuit part 6. Thereby, the voltage regulator 1 of this embodiment is allowed to speed up response or control current consumption based on the condition of the load. Further, the voltage regulator 1 can use the driver transistor of the output circuit part 6, which driver transistor requires an increase in chip area, in both the normal operation mode and the low-electric-current consumption operation mode. Therefore, the chip area is reduced so that cost reduction can be realized.

In the above-described first embodiment, only the single stage of the amplifier circuit part 22 is provided in the voltage regulator 1. However, a plurality of stages of amplifier circuit parts may be provided with the control apparatus 10 performing a control operation so that electric current consumption is stoppable in each of the amplifier circuit parts. In this case, if each of the amplifier circuit parts has the same configuration as the amplifier circuit part 22, the circuit configuration of the voltage regulator 1 is designed so that the constant voltage VA is applied via the second switch 24 to the gate of each of the NMOS transistors of the amplifier circuit parts in which NMOS transistors each form a constant current source.

[Second Embodiment]

In the above-described first embodiment, the second operational amplifier 5 operates constantly. On the other hand, in a second embodiment, the operation of the second operational amplifier 5 is stopped in the normal operation mode to further reduce electric current consumption.

Figure 6:
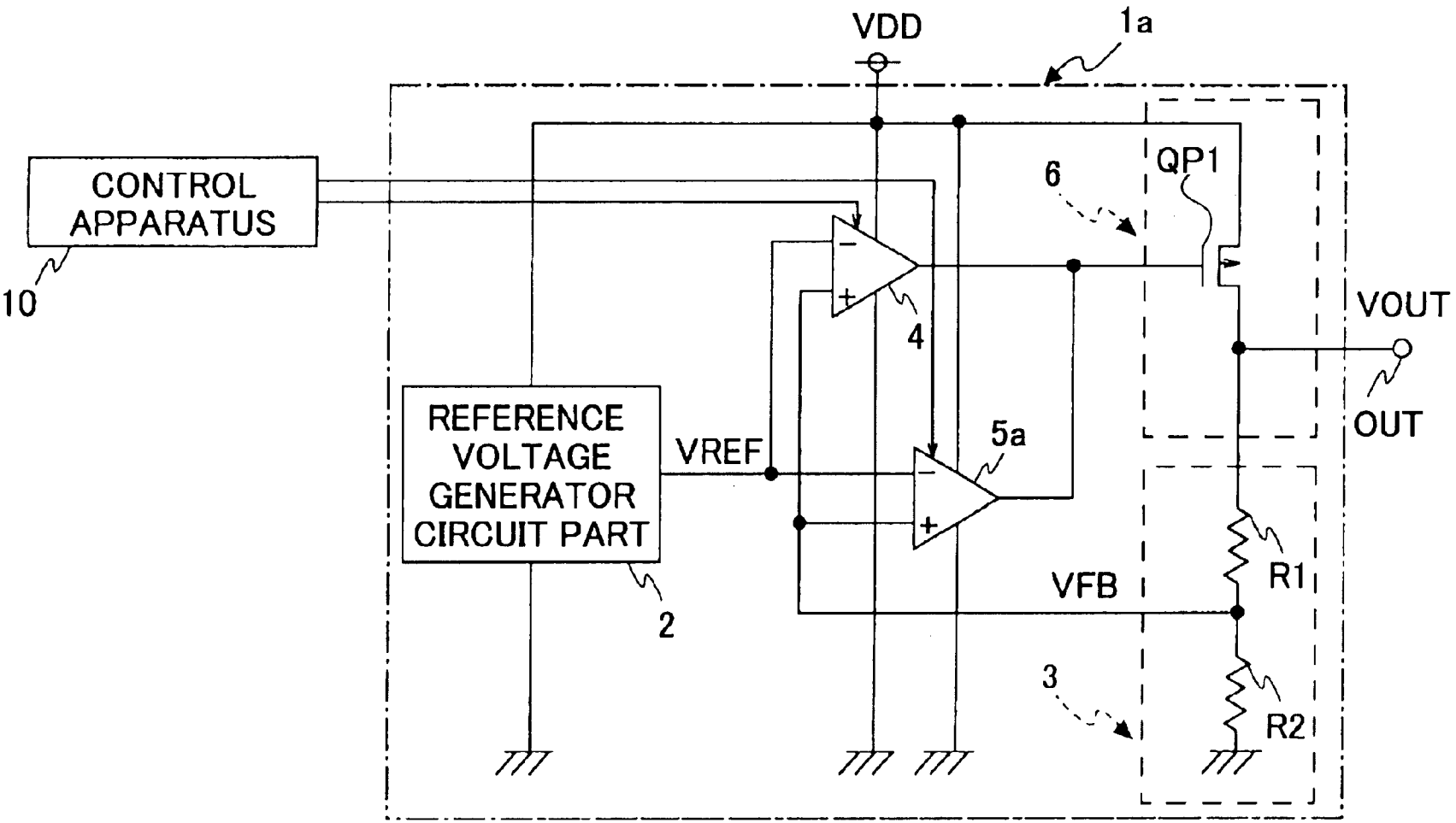
FIG. 6 is a schematic diagram showing a voltage regulator according to a second embodiment of the present invention.

FIG. 6 is a schematic diagram showing a voltage regulator la according to the second embodiment of the present invention. In FIG. 6, the same elements as those of FIG. 2 are referred to by the same numerals, and a description thereof will be omitted. The following description is given of a difference between the voltage regulator 1 of FIG. 2 and the voltage regulator 1*a* of FIG. 6.

The difference between the voltage regulator 1 of FIG. 2 and the voltage regulator 1*a* of FIG. 6 lies in that the second operational amplifier 5 of the first embodiment stops its operation so as not to consume electric current based on control signals supplied from the control apparatus 10 in the second embodiment. In FIG. 6, a second operational amplifier 5*a* corresponds to the second operational amplifier 5 of FIG. 2.

In FIG. 6, the voltage regulator 1*a* includes the reference voltage generator circuit part 2, the detection circuit part 3, the first operational amplifier 4, the low-electric-current consumption second operational amplifier 5*a* comparing the reference voltage VREF and the voltage VFB and outputting the comparison result, and the output circuit part 6.

The reference voltage VREF output from the reference voltage generator circuit part 2 is applied to the inverting input terminal of the second operational amplifier 5*a*. The voltage VFB is applied to the non-inverting input terminal of the second operational amplifier 5*a*. Further, the output voltage of the second operational amplifier 5*a* is applied to the gate of the PMOS transistor QP1 of the output circuit part 6. The operation of the second operational amplifier 5*a* is controlled based on the control signals input from the external control apparatus 10. That is, the control apparatus 10 stops the operation of the second operational amplifier 5*a* to prevent the second operational amplifier 5*a* from consuming electric current in the normal operation mode, and causes the second operational amplifier 5*a* to operate in the low-electric-current consumption operation mode.

At this point, when the control apparatus 10 causes the voltage regulator 1*a* to switch from the low-electric-current consumption operation mode to the normal operation mode, the control apparatus 10 stops the operation of the second operational amplifier 5*a* not immediately but after a given period of time passes, for instance, a few to tens of microseconds, since the start of the operation of the first operational amplifier 4. Further, when the control apparatus 10 causes the voltage regulator 1*a* to switch from the normal operation mode to the low-electric-current consumption operation mode, the control apparatus 10 stops the operation of the first operational amplifier 4 not immediately but after a given period of time passes, for instance, a few to tens of microseconds, since the start of the operation of the second operational amplifier 5*a*. Thereby, the output of a ringing waveform can be avoided at the time of switching the operation modes.

Figure 7:
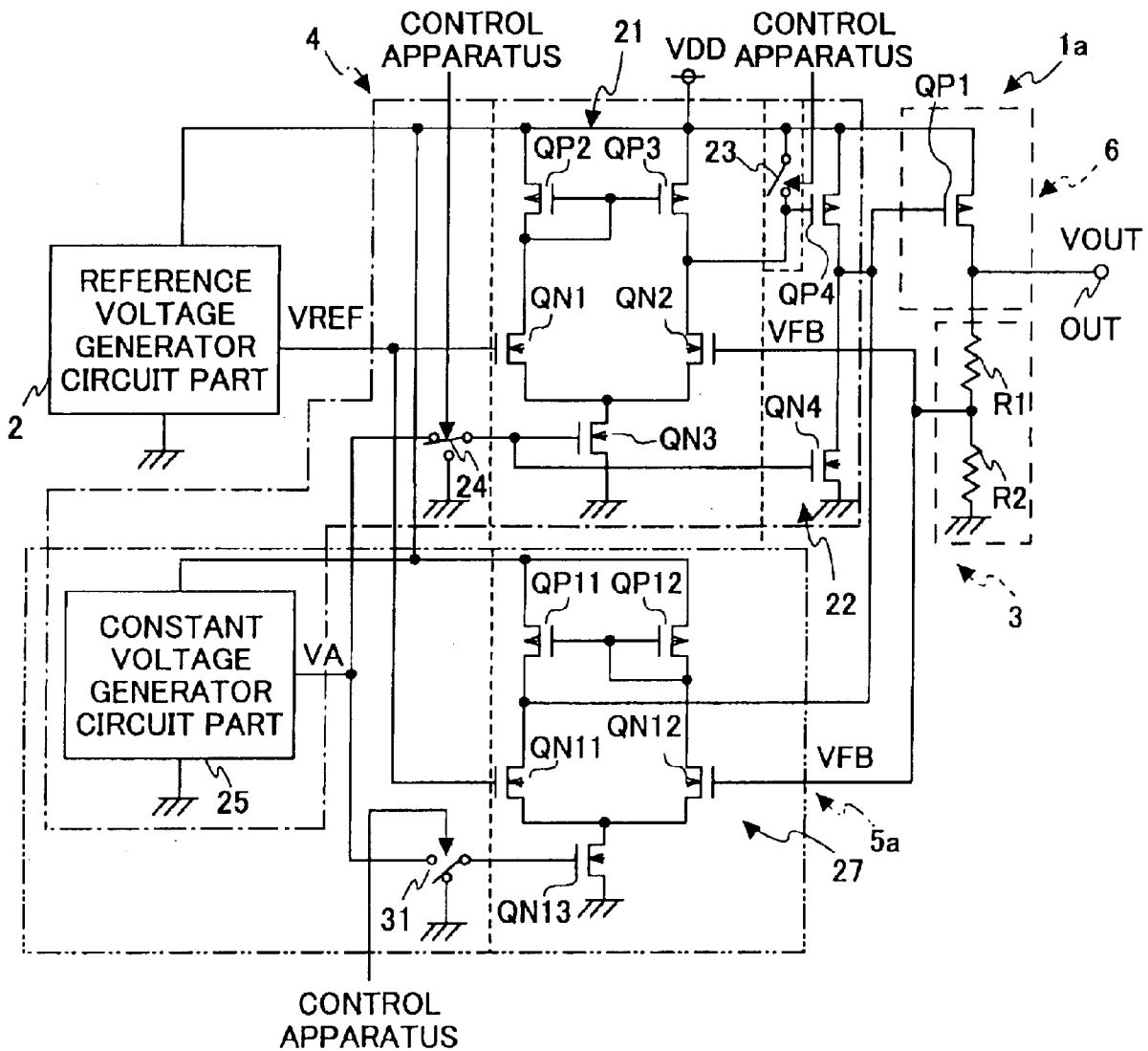
FIG. 7 is a diagram showing a circuit configuration of the voltage regulator of FIG. 6.

FIG. 7 is a diagram showing a circuit configuration of the voltage regulator 1*a* of FIG. 6. In FIG. 7, the same elements as those of FIG. 3 are referred to by the same numerals, and a description thereof will be omitted. The following description is given of a difference between the voltage regulator 1 of FIG. 2 and the voltage regulator 1*a* of FIG. 6.

The difference between the voltage regulator 1 of FIG. 3 and the voltage regulator 1*a* of FIG. 7 lies in that a third switch 31, whose operation is controlled by the control apparatus 10, is provided between the constant voltage generator circuit part 25 and the gate of the NMOS transistor QN13 in FIG. 7.

According to FIG. 7, the second operational amplifier 5*a* includes the differential amplifier circuit part 27 and the third switch 31. The differential amplifier circuit part 27 compares the reference voltage VREF supplied from the reference voltage generator circuit part 2 and the voltage VFB supplied from the detection circuit part 3 and outputs the comparison result. The third switch 31 cuts off electric current flowing through the differential amplifier circuit part 27 based on the control signal supplied from the control apparatus 10. The constant voltage VA supplied from the constant voltage generator circuit part 25 is applied via the third switch 31 to the gate of the NMOS transistor QN13 so that the NMOS transistor QN13 operates as a constant current source. The NMOS transistor QN13 and the constant voltage generator circuit part 25 form a third constant current source, and the third switch 31 forms a constant current source control part.

In the case of switching the voltage regulator 1*a* from the low-electric-current consumption operation mode to the normal operation mode with the above-described configuration, the control apparatus 10 switches OFF the first switch 23 and switches the second switch 24 so that the constant voltage VA is applied to the gate of each of the NMOS transistors QN3 and QN4. After a given period of time passes thereafter, the control apparatus 10 switches the third switch 31 so that the gate of the NMOS transistor QN13 is grounded. Thereby, an amount of electric current consumed by the second operational amplifier 5*a* can be reduced in the normal operation mode.

Next, in the case of switching the voltage regulator 1*a* from the normal operation mode to the low-electric-current consumption operation mode, the control apparatus 10 switches the third switch 31 so that the constant voltage VA is applied to the gate of the NMOS transistor QN13. After a given period of time passes thereafter, the control apparatus 10 switches ON the first switch 23 and switches the second switch 24 so that the gate of each of the NMOS transistors QN3 and QN4 is grounded.

As described above, the voltage regulator 1*a* of the second embodiment stops the operation of the second operational amplifier 5*a* to reduce the amount of electric current consumed by the second operational amplifier 5*a* in the normal operation mode. Thereby, the same effects as produced in the first embodiment can be produced in the second embodiment. Further, the voltage regulator 1*a* consumes less electric current than the voltage regulator 1 in the normal operation mode.

The voltage regulator 1*a* of the second embodiment is based on the circuit configuration of the voltage regulator 1 of FIG. 3 of the first embodiment. However, the voltage regulator 1*a* may be realized based on the circuit configuration of FIG. 4 or FIG. 5 of the first embodiment. In that case, the voltage regulator 1*a* operates in the same way to produce the same effects as in the above-described second embodiment, and therefore, a description thereof will be omitted. Further, each of the first through third switches 23, 24, and 31 of the first and second embodiments is an electronic switch circuit, but may be a switch having mechanical contacts.

The present invention is not limited to the specifically disclosed embodiments, but variations and modifications may be made without departing from the scope of the present invention.

The present application is based on Japanese priority application No. 2001-111269 filed on Apr. 10, 2001, the entire contents of which are hereby incorporated by reference.

What is claim is:

1. A voltage regulator generating and outputting a given voltage based on a preset reference voltage, the voltage regulator comprising:

a detection circuit part detecting the output voltage and generating and outputting a voltage based on the detected voltage;

first and second operational amplifiers each comparing the output voltage of said detection circuit part and the preset reference voltage and outputting a voltage representing a comparison result, said first operational amplifier being controlled based on control signals supplied externally and consuming a larger amount of electric current than said second operational amplifier; and an output circuit part comprising an output transistor outputting an electric current based on the output voltages of said first and second operational amplifiers.

2. The voltage regulator as claimed in claim 1, wherein said first operational amplifier stops consuming electric current and stops operating when a given control signal is input thereto.

3. The voltage regulator as claimed in claim 2, wherein said first operational amplifier comprises:

a differential amplifier circuit part, said differential amplifier circuit part comprising:

a differential amplifier circuit having a pair of transistors outputting a voltage that is a function of a difference between the output voltage of said detection circuit part and the preset reference voltage; and a first constant current source supplying a given constant bias current to said differential amplifier circuit;

an amplifier circuit part amplifying the output voltage of said differential amplifier circuit part and outputting the amplified voltage to the output transistor of said output circuit part, said amplifier circuit part comprising:

an amplifying transistor amplifying the output voltage of said differential amplifier circuit part and controlling an operation of the output transistor of said output circuit part; and a second constant current source supplying a constant electric current to said amplifying transistor;

an output control part controlling said amplifier circuit part outputting the amplified voltage to the output transistor of said output circuit part based on the control signal supplied externally; and a constant current source control part stopping the supplying of the constant current by each of said first and second constant current sources based on the control signal supplied externally.

4. The voltage regulator as claimed in claim 3, wherein:

each of said first and second constant current sources comprises:

a constant voltage generator circuit part generating and outputting a given constant voltage; and a transistor supplying the electric current based on the given constant voltage supplied from said constant voltage generator circuit part; and said constant current source control part controls inputting the constant voltage output from said constant voltage generator circuit part to said transistor of each of said first and second constant current sources based on the control signal supplied externally.

5. The voltage regulator as claimed in claim 4, wherein said constant voltage generator circuit part is shared by said first and second constant current sources.

6. The voltage regulator as claimed in claim 1, wherein said second operational amplifier comprises a differential amplifier circuit part, said differential amplifier circuit part comprising:

a differential amplifier circuit having a pair of transistors outputting a voltage that is a function of a difference between the output voltage of said detection circuit part and the preset reference voltage, the transistors controlling an operation of the output transistor of said output circuit part; and a constant current source supplying a given constant bias current to said differential amplifier circuit.

7. The voltage regulator as claimed in claim 1, wherein an operation of said second operational amplifier is controlled based on a control signal supplied externally so that said second operational amplifier stops consuming electric current and stops operating when a given control signal is input thereto.

8. The voltage regulator as claimed in claim 7, wherein said second operational amplifier comprises:

a differential amplifier circuit part, said differential amplifier circuit part comprising:

a differential amplifier circuit having a pair of transistors outputting a voltage that is a function of a difference between the output voltage of said detection circuit part and the preset reference voltage, the transistors controlling an operation of the output transistor of said output circuit part; and a constant current source supplying a given constant bias current to said differential amplifier circuit; and a constant current source control part stopping the supplying of the given constant current by said constant current source based on the control signal supplied externally.

9. The voltage regulator as claimed in claim 8, wherein:

said constant current source comprises:

a constant voltage generator circuit part generating and outputting a given constant voltage; and a transistor supplying a constant electric current based on the constant voltage supplied from said constant voltage generator circuit part; and said constant current source control part controls inputting the constant voltage output from said constant voltage generator circuit part to said transistor based on the control signal supplied externally.

10. The voltage regulator as claimed in claim 7, wherein the control signals are input to said first and second operational amplifiers so that one of said first and second operational amplifiers stops operating after a given period of time passes since the other one of said first and second operational amplifiers starts to operate.

* * * * *